United States Patent [19]

Larsson

[11] Patent Number: 4,791,410

[45] Date of Patent: Dec. 13, 1988

[54] ALARM SYSTEM

[75] Inventor: Erik Larsson, Västervik, Sweden

[73] Assignee: Safe Bridge AB, Vastervik, Sweden

[21] Appl. No.: 44,278

[22] PCT Filed: Jul. 22, 1986

[86] PCT No.: PCT/SE86/00341

§ 371 Date: Mar. 17, 1987

§ 102(e) Date: Mar. 17, 1987

[87] PCT Pub. No.: WO87/00666

PCT Pub. Date: Jan. 29, 1987

[30] Foreign Application Priority Data

Jul. 26, 1985 [SE] Sweden ..... 8503621

[51] Int. Cl.[4] ..... G08B 13/00; G08B 13/20

[52] U.S. Cl. ..... 340/550; 340/544

[58] Field of Search ..... 340/550, 544, 605, 608, 340/611, 626, 571, 591, 850, 573; 109/29-34; 116/70, 112, 218, 220, 266

[56] References Cited

U.S. PATENT DOCUMENTS

| | | | |
|---|---|---|---|
| 2,578,556 | 12/1951 | Johnston | 109/31 X |
| 2,663,271 | 12/1963 | Becker | 109/31 |
| 2,972,132 | 2/1961 | Putney | 340/591 |
| 3,507,229 | 4/1970 | MacDonald | 109/29 |
| 3,564,525 | 2/1971 | Robeson et al. | 340/571 X |
| 4,305,143 | 12/1981 | Simms et al. | 340/573 X |
| 4,688,024 | 8/1987 | Gadde | 340/550 |
| 4,703,313 | 10/1987 | Husmann et al. | 340/550 |

*Primary Examiner*—Glen R. Swann, III
*Assistant Examiner*—Thomas J. Mullen, Jr.
*Attorney, Agent, or Firm*—Sughrue, Mion, Zinn, Macpeak and Seas

[57] ABSTRACT

An alarm system comprising at least one signal line (2, 4) for indicating damage to and/or an attempt to interferewith the line. The line is particularly suitable for incorporation in a net-structure particularly intended for use as a barrier net for denying foreign objects, such as under-water vessels, frogmen and the like access to water passageways, channels etc. To this end the signal line includes suitably flexible tubing (2, 4) which contains a coloured indicating or marking agent and is connected to sensors (8–11) which are constructed to cause an alarm signal to be given when there is a change in pressure and/or in the flow conditions in the tubing. The indicating agent in the tubing—suitably a coloured liquid—is placed under a pressure of such magnitude that in the event of perforating damage, such as a fracture or rupture, to the tubing the agent will exit therefrom and indicate visually the location of the fracture signalled by one of the sensors (8–11).

8 Claims, 1 Drawing Sheet

ALARM SYSTEM

BACKGROUND OF THE INVENTION

The present invention relates to an alarm system which includes at least one signal transmission line for providing an indication of damage to the line and/or an attempt to interfere with it, said line being suitable for incorporation in a net-structure, for example a barrier net-structure for denying foreign objects, such as underwater vessels, frogmen, and the like, access to underwater passageways, channels, etc.

Barrier net-structures intended for the aforesaid purpose are constructed to take-up extreme tensile forces. Nevertheless it is desirable that they are provided with some form of alarm system which will indicate the successful passage, e.g. of a submarine through the net, in spite of all precautions, or signal an alarm should the net be interfered with in some way. Among other things, the anchorage of the net-structure to the bed of the waterway should be protected with such an alarm system.

There has been proposed in the art an alarm facility in which a closed circuit current is passed through an electric conductor incorporated in the net. Although this arrangement functions satisfactorily enough in general, it is encumbered with a number of disadvantages. For example, the arrangement is highly sensitive, especially when used underwater, and is liable to give false alarms, due to its sensitiveness to all forms of disturbance. In addition, repairs to the net-structure require it to be lifted from the water. Another drawback is that when using large net-structures comprising several sections, or a plurality of small net-structures, the task of laying the conductor or conductors in the net(s) becomes relatively complicated. The requisite alarm centre also becomes relatively complicated since in the case of an alarm, it must be capable of indicating which net-section was responsible for the alarm being given. It is impossible to indicate the exact position in any event. Moreover, the costs and time involved in investigating such false alarms are quite considerable. Minor faults in the insulation of an electrical system must be repaired immediately, however. It is also possible to manipulate electrical systems with the aid of shunt couplings, e.g. at the shoreside connections.

SUMMARY OF THE INVENTION

The main object of the invention is to provide an alarm system with which at least the aforesaid drawbacks are removed and while affording a particular advantage when used in barrier net-structures for protecting water passageways can also be used effectively in other connections—even on land.

This is achieved in accordance with the invention by replacing or complementing the electrical conductor used in prior art net-structures with a flexible tube containing a coloured indicating agent in liquid, gas, or powder form, this tube being connected to a signal-emitting sensor constructed to detect changes in pressure and/or the state of flow in the tube. The indicating agent is therewith under pressure in the tube and in the event of a fracture or rupture will flow from the tube and indicate the location of said fracture.

Such a system can be extended to any extent without becoming complicated. The system is also extremely failsafe and in the event of a fault can be repaired readily, even under water, and will indicate visually the precise location of the fault in question, or the location at which the net has been perforated, in the event of such an occurrence.

In addition to the aforesaid alarm function and to the advantage of being not-readily manipulated, the powerful action of the pressurized indicating agent as it is ejected from a fractured tube in the event of an attempt to force an entry through the net has a pronounced shock effect which can give the impression of an explosion. The indicating agent used may also be one which will totally obstruct the vision of those in the vicinity thereof and therewith render further activities impossible.

When the alarm system is to be used under water, the indicating agent shall have a density lower than that of water, so that when released the agent will float to the surface. When using a liquid indicating agent in underwater systems, the tube is preferably connected to an air inlet, so that the agent exiting from a fractured pipe is admixed with air, which accelerates the liquid on its way to the surface, therewith shortening the time required to reach said surface.

In accordance with a preferred embodiment, the tube is connected to a pressurized container for storing the indicator agent, the tube being constructed in a manner which prevents it from being compressed to such an extent as to completely close the channel extending therethrough. For example, the tube may be provided with internal, axially extending ribs and/or may incorporate an internal wire helix, or some other hard core element.

In accordance with another embodiment, the alarm system incorporates a flow sensor which is arranged to produce an alarm signal in the event of a large flow from the container as a result of a tube fracture, and a pressure sensor for indicating a drop in pressure resulting, for example, from a slight or minor leakage. In this case, the tubing can be incorporated in a closed system with no return. In accordance with another embodiment the system includes a pump which constantly circulates the indicating agent through the tubing, which in this case is connected in a closed loop arrangement.

BRIEF DESCRIPTION OF THE DRAWINGS

The invention will now be described in more detail with reference/to the accompanying drawing, in which.

DETAILED DESCRIPTION OF THE PREFERRED EMBODIMENTS

Figure 1:
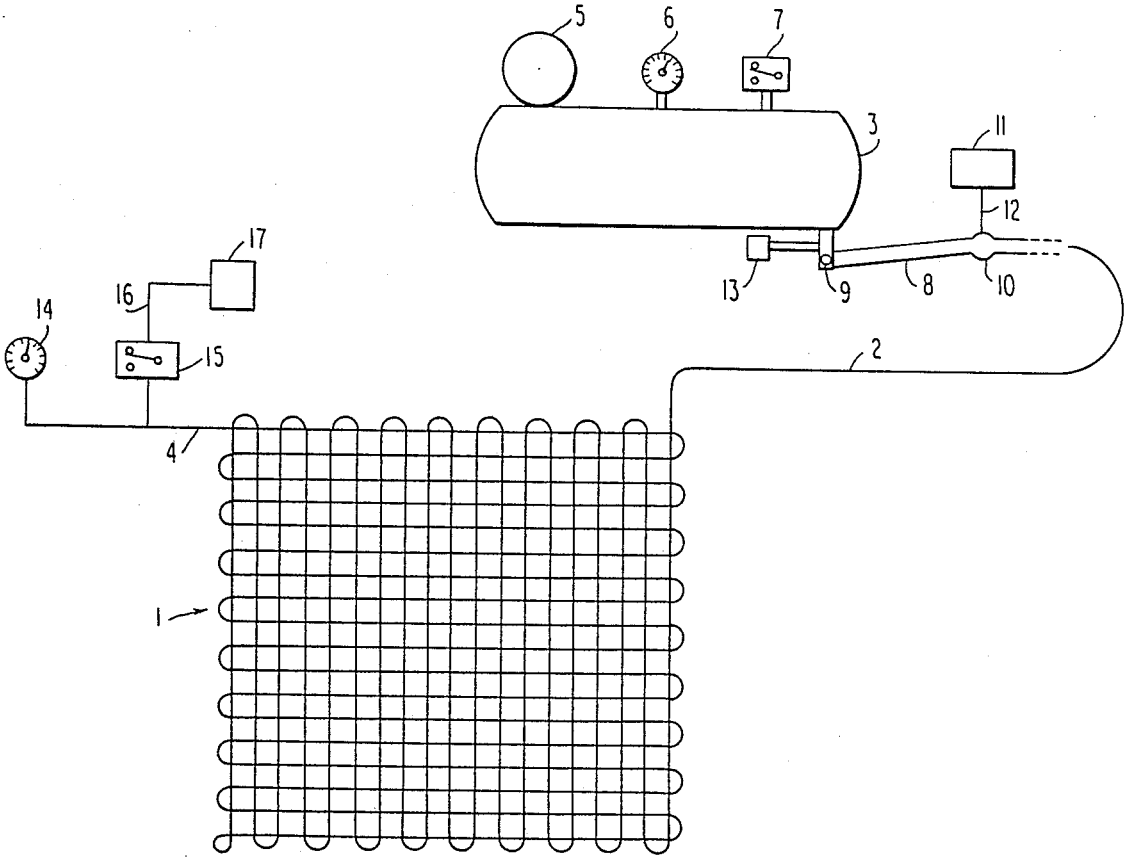
FIG. 1 is a schematic illustration of an alarm system according to the invention.

FIG. 1 illustrates a net-structure 1 for blocking an underwater passage. Although the illustrated net-structure is formed from a single part it will be understood that it may also be comprised from several parts, e.g. one part for the illustrated vertical loops, and another part for the horizontal loops. The net part (or parts) may be formed solely from flexible rubber tubing. In order to enhance the tensile strength of the tubing, however, it is preferably covered with polyester/silk. Each net part may also incorporate a steel wire and optionally also an electrical and/or optical signal conductor.

Figure 2:
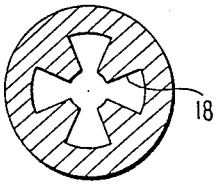
FIG. 2 is a cross-sectional view of a plastic tube which can be included in the system illustrated in FIG. 1.

In the case of a closed system without return and flow of agent therethrough, the tubing is constructed in a manner which prevents it from being squeezed together or compressed to an extent which completely closes the channel therethrough, thereby to prevent one section of the net from being isolated from another section thereof by squeezing the tubing from the outside. For example, the tubing may be given the cross-sectional form illustrated in FIG. 2, so as to incorporate longitudinally extending ribs 18. Alternatively, the tubing may incorporate an internal wire helix, a thin steel wire, or rope, or some other hard core element. This core element prevents the tubing from being bent or compressed to such an extent as to cause the inner wall surfaces to seal against one another. Any attempt to squeeze a flexible tube fitted with a hard core to the aforesaid extent will cause the wall surfaces of the tubing to fracture from the inside.

The net structure illustrated in FIG. 1 is supplied with a coloured low-density liquid from a storage vessel 3, through tubing 2. This liquid may serve as a signalling agent and comprises, for example, yellow or orange pigment dissolved in white spirit. The terminal end of the net 1 is connected to a conduit 4. The storage vessel 3 is only partially filled with signalling liquid, the remaining space being filled with pressurized air which is held at a given overpressure with the aid of a compressor 5. Reference numeral 6 identifies a manometer and 7 a pressure switch which controls the compressor. The pressure switch may be constructed to operate at an activating pressure of 3 bars and a deactivating pressure of 7 bars.

The tubing 2 is connected to the storage vessel 3 via a sloping pipe section 8 in which a ball 9 is arranged for movement into engagement with a switch seating 10. The switch seating 10 is connected to an alarm unit 11 through a signal conductor 12. Reference numeral 13 identifies an ejector device which is operative to mix air with the liquid flowing from the vessel 3 and into the tubing 2 in the event of a fracture in the net.

The conduit 4 connected to the terminal end of the net communicates with a manometer 14 and a pressure switch 15, which is activated, switched-on, when the pressure in the conduit 4 has decreased to 5 bars. A signal conductor 16 extends from the pressure switch 15 to an indicating device 17.

The aforedescribed embodiment has the following method of operation. In normal conditions the compressor 5 maintains a constant liquid pressure of about 7 bars in the net tubing. The ball does not prevent, or be influenced by minor flows of liquid from the vessel 3 to the net 1 through the pipe section 8. If, on the other hand, a water craft breaks through the net, therewith tearing away the tubing, or if a net-loop is cliped or sawn away, a powerful flow of liquid to the net, through the pipe section 8 will take place. This flow of liquid drives the ball 9 onto the switch seating 10, therewith making an electrical switch and causing a signal to be sent immediately to the alarm unit 11. The flow of liquid to the net is not impeded by the ball when the ball is seated on the seating 10. The switch contact made by the ball can be effected, e.g. metallically, inductively or magnetically.

The coloured liquid delivered to the net flows therethrough until reaching the fracture location whereupon the liquid exits from the net and rises to the surface. Transportation of the liquid to the surface of the water is accelerated substantially by the air delivered to the liquid in the tubing 2 by the ejector device 13, this air resulting in a pronounced "boiling effect". The coloured liquid, suitably yellow or orange, can be readily discerned, e.g. from an aircraft, thereby enabling the position of the fracture to be established very quickly after an alarm has been given. The coloured signalling or marking liquid is also suitably one for rendering the area in the vicinity of the fracture totally opaque, so as to render any manual activity in the region of the exiting liquid practically impossible for a considerable length of time after a fracture has taken place. In addition, the explosive manner in which the liquid is released from the net produces an effect of shock, which also delays continued activity.

Thus, when a fracture occurs in the net loop an alarm to this effect is given immediately, and subsequently, soon afterwards, an indication of the fracture location. No corresponding alarm is given, however, when the pressure in the system falls slowly, since the flow of liquid commensurate with a slow fall in pressure is insufficient to carry the ball 9 onto its seating 10 in the pipe 8. A slow fall in pressure may be due, for example, to a small leak in the system. In this regard, the pressure switch 15 is located at the terminal end of the net and is set to send a signal to the indicating device 17 when, for example, the pressure has dropped to five bars. Thus, a drop in pressure due to a leakage in the system will not result in a false alarm being given and the subsequent organization of emergency services, but will merely result in a simple indication of a fault in the system. The location of this fault can be found quite easily, through the agency of the coloured liquid flowing from the fractured or ruptured tubing or, if the storage vessel 3 is empty, by the air bubbles which rise to the surface of the water. Normally, once the fault is localized it can be repaired on site, without needing to remove the net from the water.

As an alternative embodiment with regard to the positioning of the pressure switch at the terminal end of the net, a corresponding switch can be connected advantageously to the storage vessel 3 and given a pressure setting which lies slightly beneath the compressor deactivating pressure, which in the illustrated embodiment is assumed to be 7 bars. For example, if the additional pressure switch is set to a pressure of 6.9 bars and is constructed to send a signal to a monitoring centre when activated, it is possible to determine the magnitude of the leak and what auxiliary measures may be required as a result thereof by measuring the time lapse between the time at which the compressor was last deactivated and the time at which the new pressure switch was activated. This time interval can be measured and recorded automatically. Instead of utilizing the deactivation of the compressor, an additional signal-producing pressure switch can be connected to the storage vessel and given an activating setting at, for example, 6.9 bars. A return line from the terminal end of the net is not necessary, which further simplifies the system and again decreases the cost thereof.

An important feature of the described embodiment is the delivering of air to the liquid in the tubing 2, since a comprehensive air/liquid mixture gives rise to a powerful and readily discerned "upsurge" of the air through the water, this upsurge effectively entraining the coloured liquid to form a well confined patch on the surface of the water. If the coloured patch is not well confined in this way, there is a risk that the patch will become diffuse and reach the surface at a location remote from the fracture location, particularly in the case of strong winds, heavy currents or when the net is erected in very deep water.

In order to decrease the influence exerted on the signal line by a fall in net pressure due to a fracture in the net, pressurized-air reservoirs may be integrated with or connected to the net at uniform distances apart. With this arrangement, an amount of liquid corresponding to the volume of gas delivered is immediately forced from the net at the point of fracture, irrespective of the distance of the fracture from the delivery end.

The use of a flow sensor according to the aforegoing provides a particular advantage, because among other things it enables the system to be extended with a desired number of net sections, since the flow sensor will also produce a signal even when a fracture occurs in parts of the net which are not incorporated directly in a closed circuit. When solely the pressure prevailing in the system is sensed, it is possible that the system will take a long time to react to a change in state, particularly when the storage vessel contains a large volume of air.

Although the alarm system has been described above with particular reference to its use under water, it will be appreciated that the system can also be used on land, for example to guard military supply depots and similar establishments. It may also be modified for use in connection with, e.g. banks and stores. When used on land, the signal line is suitably filled with a stinging or irritating gas, which may also be coloured. The use of powder or foam is also conceivable.

The system described with reference to the drawing should be seen solely as an exemplifying embodiment of the invention which can be modified in various respects within the scope of the invention. For example, the ball-type flow sensor may be replaced with a different type of sensor. The system may also comprise solely pressure sensing devices, wherein the fall in pressure occuring in the event of a net fracture initiating an alarm. The liquid used in the system may also be of a kind which will generate smoke when reaching the surface of the water, and using a suitable gas a signal flame can also be produced. The illustrated compressor may be replaced with a pressurized-air bottle fitted with a reduction valve, particularly in the case of smaller systems.

I claim:

1. An alarm system, comprising: a signal line (2, 4) for indicating damage to and/or an attempt to interfere with said line, said line being suitable for incorporation in a net-structure particularly intended for use as a barrier net for denying foreign objects, such as underwater vessels, frogmen and the like access to water passageways, channels, etc., wherein the signal line contains a fluid and is connected to sensors (8–11) constructed to generate an alarm signal in response to a change in pressure and/or in the flow conditions in said line; the signal line including a flexible tubing constructed to prevent the flow channel extending therethrough from being completely closed by squeezing or compression forces, said fluid comprising a coloured indicating agent subjected to a pressure of such magnitude that in the event of perforating damage to the tubing, such as a fracture or rupture, the agent will exit from the tubing and indicate visually the location of the fracture signalled by one of the sensors, and the indicating agent having a density below that of water, so that when the alarm system is used under water said agent will flow to the surface of the water.

2. An alarm system according to claim 1, wherein the indicating agent in the tubing is a liquid, and the tubing is connected to an air inlet (13), such that in the event of perforating damage to the tubing the indicating liquid is admixed with air to accelerate the liquid in its passage to the surface of the water.

3. An alarm system according to claim 1, wherein the liquid is intended to render the water opaque in the region of said perforating damage to the tubing.

4. An alarm system according to claims 1, 2 or 3, wherein the tubing is connected to a pressurized vessel (3) for storing said indicating agent.

5. An alarm system according to claim 4, wherein said sensors include a flow sensor arranged to initiate an alarm signal when detecting a large flow of agent from the vessel (3) resulting from perforating damage to the tubing, and a pressure sensor arranged to produce a signal which indicates a fall in pressure due, for example, to a minor leakage in the system.

6. An alarm system according to claim 4, wherein the tubing is incorporated in a closed system without return to the storage vessel (3).

7. An alarm system according to claim 1, wherein the tubing is provided internally with longitudinally extending ribs (18) and/or a tightly-wound wire helix, or some other hard core element.

8. An alarm system according to any of claims 1, 2 or 3, wherein the system incorporates a pump for constantly circulating the signalling agent through the tubing coupled in a closed circuit.

* * * * *